United States Patent [19]

Schippers et al.

[11] Patent Number: 4,659,027

[45] Date of Patent: Apr. 21, 1987

[54] METHOD AND APPARATUS FOR WINDING TEXTILE YARNS

[75] Inventors: Heinz Schippers, Remscheid; Friedhelm Lenz, Wuppertal, both of Fed. Rep. of Germany

[73] Assignee: Barmag Barmer Maschinenfabrik AG, Remscheid, Fed. Rep. of Germany

[21] Appl. No.: 765,709

[22] Filed: Aug. 14, 1985

[30] Foreign Application Priority Data

Aug. 18, 1984 [DE] Fed. Rep. of Germany ..... 3430504
Nov. 17, 1984 [DE] Fed. Rep. of Germany ..... 3442095

[51] Int. Cl.[4] ..... B65H 54/38; B65H 54/32
[52] U.S. Cl. ..... 242/18.1; 242/43.1
[58] Field of Search ..... 242/18.1, 43 R, 43.1

[56] References Cited

U.S. PATENT DOCUMENTS

| | | | |
|---|---|---|---|
| 3,730,448 | 5/1973 | Schippers et al. | 242/43.1 |
| 3,876,166 | 4/1975 | Kodokura et al. | 242/158.2 |
| 4,221,344 | 9/1980 | Lohest | 242/18.1 |
| 4,296,889 | 10/1981 | Martens | 242/18.1 |
| 4,325,517 | 4/1982 | Schippers et al. | 242/18.1 |
| 4,498,637 | 2/1985 | Yamamoto et al. | 242/18.1 |
| 4,504,021 | 3/1985 | Schippers et al. | 242/18.1 |
| 4,504,024 | 3/1985 | Gerhartz | 242/18.1 |
| 4,555,069 | 11/1985 | Maeda et al. | 242/18.1 |

FOREIGN PATENT DOCUMENTS

| | | |
|---|---|---|
| 102849 | 3/1984 | European Pat. Off. . |
| 118173 | 9/1984 | European Pat. Off. . |
| 1568148 | 5/1980 | United Kingdom . |

*Primary Examiner*—Stanley N. Gilreath
*Attorney, Agent, or Firm*—Bell, Seltzer, Park & Gibson

[57] ABSTRACT

A method and apparatus for winding textile yarns into core supported packages is disclosed, and which is characterized by the ability to produce relatively large packages which are adapted to permit a high speed unwinding by withdrawal of the yarn over one end of the package. The method and apparatus involves controlling the yarn traverse guide so as to include stroke modification cycles during which the traverse stroke is progressively contracted and then increased, with the stroke modification cycles being designed to produce a precisely cylindrical package end with a uniform distribution of hardness along the package. In one illustrated embodiment, a number of stroke modification cycles having a relatively large contraction alternate with a number of stroke modification cycles having a relatively small contraction. In addition, the speed of the yarn guide may be constantly accelerated and decelerated to avoid undesirable patterns, with the changes in speed being coordinated with the stroke modification cycles to provide a uniform yarn tension in the package.

27 Claims, 8 Drawing Figures

METHOD AND APPARATUS FOR WINDING TEXTILE YARNS

The present invention relates to the winding of textile yarns into core supported packages, and more particularly the random winding of a cylindrical cross wound package of a textured yarn, such as a false twist textured filament yarn. In such winding operations, the end faces of the cylindrical package may lie in a normal plane (winding with straight end faces), or the end faces may be inclined relative to this normal plane (biconical winding).

A randomly cross wound package in the context of the present invention is a cross wound package having a winding ratio which is constantly or periodically variable during the course of the winding cycle. The "winding ratio" is here understood to mean the ratio of the package speed (revolutions of the package per minute) to the traversing speed (number of double strokes per minute). Packages of the described type are described in DIN 61800 (German Industrial Standards), and they are commonly produced on the winding systems of yarn texturing machines. In such machines, the yarns receive crimp-elastic properties from their treatment, in particular the false twist texturing operation.

It is known that the end areas of cylindrical packages often include bulges which result from an unavoidable deposit of an unduly large quantity of yarn in the area of stroke reversal. In order to avoid such bulges at the package ends, it is known to periodically modify the traverse stroke, by a periodic shortening and lengthening of the stroke in the area of these bulges. From investigations as to the unwinding behavior of packages, it has surprisingly been found that a flattening, i.e. a reduction in the bulge, of the cylindrical surface area of the cross wound package on the end opposite to the unwinding end of the package, results in substantially improved unwinding properties of the yarn. In this regard, such packages are commonly mounted on a creel, with the yarns being withdrawn in an axial direction over one end of the package. The unwinding end of the package is usually identified by a rounded edge on the supporting core or bobbin tube, and a yarn transfer tail which is used to connect the beginning of a yarn on one package with the end of a yarn on a successive package, is positioned at the opposite end, i.e. the end opposite the unwinding end.

As noted above, a flattening of the surface area on the end opposite the unwinding end results in improved unwinding properties. In contrast thereto, bulged formations on the unwinding end of the package, have no disadvantageous unwinding consequences. This result was extremely unexpected, inasmuch as the opposite result would have been expected from experience with the unwinding behavior of yarns from conical packages.

It should also be noted that the flattening of the cylindrical surface of the cross wound package in accordance with the present invention is not an inclined face, as is obtained in the production of biconical, cross wound packages by uniformly shortening the stroke of the traverse guide. Rather, the flattening is an intentionally produced uniform reduction of the diameter on at least the end of the cylindrical package which is opposite to the unwinding end of the package. Such packages may be produced in a winding system for cross wound packages, by providing the yarn traverse system with means for a periodic contraction and lengthening of the stroke of the traversing yarn guide (i.e. stroke modification), together with a ribbon breaking mechanism. The length of the modified strokes may be substantially decreased, for example, to about 20 mm contraction of the stroke at one or both ends of a basic stroke of the traversing yarn guide of about 250 mm.

Packages which are produced in the above manner have however, relatively soft frontal surfaces. Depending on the type of further processing, the soft surfaces are undesirable since they are more easily damaged than hard packages. Thus in many instances, and in particular because of the resulting transport and handling problems, such packages have proven to be undesirable despite their favorable unwinding properties. However, in accordance with the present invention, the advantages of packages with flattened ends are maintained. In addition, unduly soft package ends are avoided, and a package with a desired controlled hardness together with excellent unwinding properties is produced. The present invention thus proceeds from the method disclosed in U.S. Pat. No. 4,325,517, in which the length of the traverse stroke is varied.

It is accordingly an object of the present invention to provide a method and apparatus for winding yarns which is adapted to produce a package of relatively large diameter, and yet which insures a satisfactory overhead withdrawal of the yarn at high unwinding speeds, of for example, 1000 m/min.

This and other objects and advantages of the present invention are achieved in the embodiments illustrated herein by the provision of a winding method and apparatus which includes controlling the traverse of the yarn guide at at least one end of the package in a recurrent series of yarn deposit intervals, with each interval being divided into at least two segments, with the first segment comprising at least one stroke modification cycle in which the length of the strokes of the yarn guide is progressively decreased to a maximum contraction and then progressively increased, and with the second segment comprising at least one stroke modification cycle in which the length of the strokes of the yarn is progressively decreased to a minimum contraction and then progressively increased. Preferably, the minimum contraction is less than about 60 percent of the maximum contraction.

The present invention may be advantageously used to produce cylindrical packages having either straight end surfaces, or inclined end surfaces (biconical packages), when viewed in their longitudinal section.

In a preferred embodiment of the invention, several stroke modification cycles may occur within one or both of the segments of the yarn deposit intervals. Thus for example, within the yarn deposit segment having large stroke modification cycles, the cycles may be varied, and preferably reduced in stages, from one modification cycle to another. In the following segment with small stroke modification cycles, the small cycles are preferably less than 60 percent and most preferably less than 50 percent, of the large stroke modification cycles. Within the second segment, the stroke modification cycles may be in groupings, with one grouping having the same modified stroke, and the subsequent groupings having progressively smaller modified strokes. In this manner, a package is formed with differing wound layers. During the yarn deposit segments having the large stroke modification cycles, a flattened and soft wound layer is formed at the ends. During the yarn deposit segments having the smaller stroke modification cycles, the flattened end areas of the package are substantially filled and covered with a hard layer, so that the hard layer protects the soft layer, and with the underlying soft layer providing for a certain amount of flattening, and as a result assuring good unwinding properties throughout the package. Thus a specific package is formed which externally has a good appearance, is easy to handle, and which has satisfactory unwinding properties.

In another embodiment of the invention, the yarn deposit segments with the large stroke modification cycles, and the yarn deposit segments with the small stroke modification cycles directly follow each other. In this further embodiment, a single stroke modification cycle occurs within the yarn deposit segment having the large cycles, while several identical stroke modification cycles follow each other within the segments of small cycles. Preferably, a rest time, i.e. a time during which the traverse stroke is unchanged, is positioned between each of the stroke modification cycles of the second segments. As a result, it is provided that the time in which the yarn traversing system is operated with large stroke modification cycles may be maintained at a desired ratio to the time in which the yarn traversing system operates with the small stroke modification cycles. This ratio typically ranges from about 1.8 to 1 and 1.2 to 1. This ratio is empirical, and an adherence to the ratio may be significant to achieve the desired unwinding properties.

In a further embodiment of the present invention, both the large and the small stroke modification cycles may be reduced in steps from one yarn deposit interval to the next, with the largest small stroke modification cycle then amounting to more than 50 percent, preferably between 60 and 80 percent of the smallest large stroke modification cycle. In this arrangement, two to ten steps, each with reduced stroke modification cycles, may follow each other.

Another possibility of favorably effecting the package build, and of improving the unwinding properties of the yarn, is provided by the present invention in that the contraction and/or lengthening speeds of the stroke modification cycles i.e, the rate of the decrease in the stroke length and/or the rate of the increase in the stroke length, may be controlled. The control of the contraction and/or lengthening speeds of the cycles defined by the traversing yarn guide permits the adjustment of the time of the cycles irrespective of the magnitude of the cycles. Such control also permits a rest time of any desired length to be placed between two stroke modification cycles or between two yarn deposit intervals, without having to change the total duration of the yarn deposit interval, i.e., the duration of a yarn deposit interval including the rest time.

A further aspect of the present invention provides that the stroke of the traversing yarn guide maintained between the stroke modification cycles, and which normally corresponds to the package length, may be temporarily narrowed or reduced. As a result, a further parameter for influencing the formation of a package with desirable unwinding properties is made available. The traverse stroke may be continuously varied between two outer and two inner limits, with the outer and inner limits also being varied.

From the above, it will be seen that the present invention makes available a number of controllable process parameters for the build of a precisely cylindrical package, which has a uniform hardness over its length. For example, the extent of the contractions of the stroke of the traversing yarn guide, as well as the duration of the respective yarn deposit segments for the large and small stroke modification cycles may be selected. In addition, one or more of the following process parameters may be controlled, including the number of the stroke modification cycles per yarn deposit interval, the variation of the large and small stroke modification cycles within a yarn deposit interval and in the following yarn deposit interval, the contraction speed and lengthening speed of the stroke modification cycles, the duration and number of rest times, and the narrowing of the stroke of the traversing yarn guide between two stroke modification cycles or yarn deposit intervals, respectively.

The selection of the above parameters depends on the type of yarn, its denier, its advancing and winding speed, the length and maximum diameter of the package, the angle at which the yarn is deposited on the package, as well as other conditions. The specific selection of the parameters is preferably made as a result of trials.

The significance of the present invention resides in the fact that certain basic parameters, and a large number of secondary parameters as noted above, are made available so as to accomplish a satisfactory package build with good unwinding properties, in each instance.

It is known that the quality of the yarn package also depends on the tension under which the yarn has been wound onto the package. A particular criterium for good unwinding properties is the uniformity of this tension over the yarn length and over the length of the package. The present invention also provides that the traversing speed may be varied for the purpose of breaking the patterns or ribbons, and may be changed between a minimum and a maximum value. To insure uniform yarn tension, the minimum value occurs at about the mid point of the yarn deposit segment having small stroke modification cycles, and the maximum value of the speed occurs at about the mid point of the yarn deposit segment having large stroke modification cycles. As a result, the reduction of the traverse speed which is produced by shortening the traverse stroke is compensated by an increase of the rate of double strokes defining the frequency of the traverse speed, i.e., the number of the reciprocal movements of the traversing yarn guide per unit of time. The ratio of double strokes is preferably controlled so that its maximum coincides with the maximum point of a large stroke modification cycle.

Another possibility for making the yarn tension uniform in accordance with the invention, may be provided in that the circumferential speed of the package is temporarily and slightly reduced and increased in such a manner that the yarn tension remains constant. For this purpose, the circumferential speed should be varied only slightly as a result of the synchronization of the stroke modification and ribbon breaking functions provided by the present invention.

Each stroke modification cycle may be defined as the time in which the path of the traverse stroke of the traversing yarn guide is shortened according to a predetermined law, from the maximum path of the traverse to a minimum path of the traverse, and then again lengthened to the maximum path of traverse. Thus, a number of modified strokes may occur within each stroke modification cycle. It is also possible and advantageous, to operate the traverse system with an intermediate traverse stroke, which is slightly narrowed or reduced, rather than at the maximum traverse stroke which substantially corresponds to the length of the yarn deposited on the package. This narrowing is particularly useful during the rest times between two stroke modification cycles. The narrowing, i.e., half the difference between the maximum traverse stroke and the intermediate traverse stroke preferably amounts to between about 20 and 50 percent of the smallest stroke modification cycle.

Another possibility for obtaining a variation of the traverse stroke in accordance with the present invention resides in the fact that the package may be built with a so-called displacement of the stroke. In a stroke displacement, the length of the traverse stroke remains constant, but the traversing yarn guide is displaced relative to the package. Such displacement may occur either periodically, or after predetermined intervals and over a predetermined period of time. Also, the present method permits the formation of a package which consists of alternating soft and hard wound layers. For this purpose, there may be another stepwise variation of the maximum length of the yarn deposit, which is analogous to the above described method by which the large and small stroke modification cycles occur in steps and preferably within the individual yarn deposit segments.

Some of the objects and advantages of the present invention having been stated, others will appear as the description proceeds when taken in conjunction with the accompanying drawings, in which—

Referring more particularly to the drawings, it will be understood that the present invention relates to a method and apparatus for winding textile yarns which includes means for supporting and rotating suitable package cores to wind a textile yarn therearound at a substantially constant rate, and a traversing yarn guide for guiding the yarn onto the rotating package core. Such textile winding apparatus are well known to persons skilled in the textile arts.

In accordance with the present invention, the winding apparatus is provided with a controllable stroke reduction means, means for continuously varying the traverse motion speed of the traversing yarn guide, and control means for controlling the stroke reduction means and traverse speed varying means according to a predetermined program, and so as to provide a desired package configuration which has desirable unwinding characteristics. A specific embodiment of the apparatus is described below in conjunction with FIGS. 7 and 8.

Figure 1:
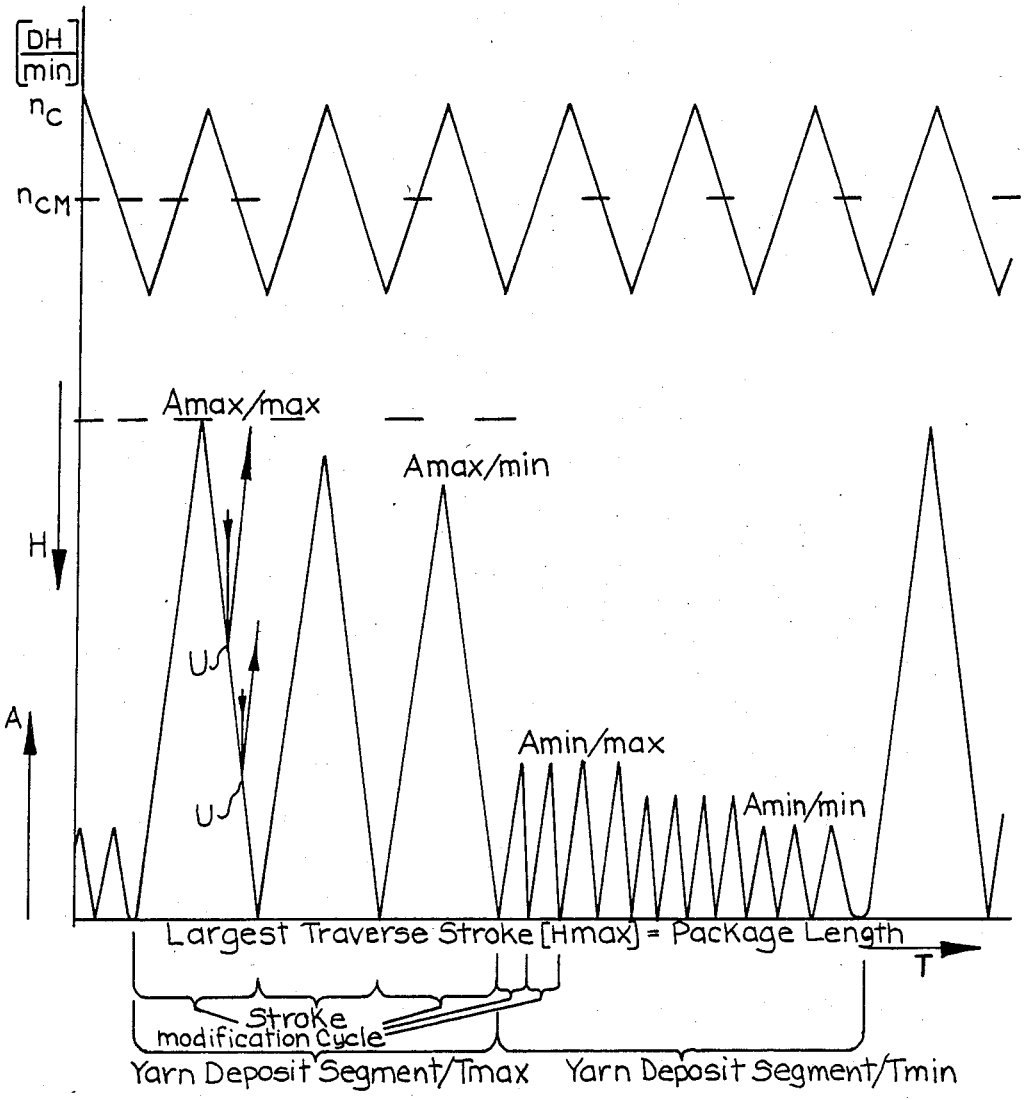
FIG. 1 is a schematic motion diagram illustrating the effects of traverse stroke modification and traverse speed change in accordance with one embodiment of the present invention.

FIG. 1 illustrates the motion diagram of a winding method in accordance with one embodiment of the present invention. The upper portion of FIG. 1 is a diagram illustrating that the traverse speed nC is continuously varied about a mean value nCM, for the purpose of breaking the repeating patterns or ribbons. The lower portion of FIG. 1 is a diagram which illustrates the stroke modification over time T, which preferably proceeds concurrently with the ribbon breaking, and so as to have a positive effect on the yarn tension.

The stroke modification as illustrated includes the shortening of the traverse stroke H. In the case of cylindrical packages with straight or square front ends, the largest traverse stroke corresponds substantially to the package length. In the case of biconical packages, which have conical ends, the largest traverse stroke corresponds to the length of the yarn deposited on the package, note FIG. 2. In the context of the present description, the traverse stroke H may be also described as the stroke of the traversing yarn guide. The segmented arrows respectively indicate the position of the reversal points U of the traversing yarn guide, and thus indicate the contraction A of the traverse stroke H measured from the abscissa. A few such reversal points U are indicated in FIG. 1. In the case of a biconical package, the contraction A on one end of the package is half the difference between the greatest and the smallest stroke of the traversing yarn guide within a stroke modification cycle, which may also be described as a modified stroke.

The method of the present invention involves the step of controlling the traverse of the yarn in a recurrent series of yarn deposit intervals as indicated in the lower portion of FIG. 1. Each such interval is divided into a number of yarn deposit segments, with two such segments being illustrated and advantageous. During the first yarn deposit segment of each interval, the length of the strokes H is progressively decreased to a relatively large contraction A max/max, which is the point of the greatest modified stroke, and the stroke is then progressively increased to define a stroke modification cycle. In addition, the first yarn deposit segment consists of several such stroke modification cycles, with successive cycles having different maximum contractions A. Very good results are achieved, when three such stroke modification cycles occur during the first yarn deposit segment, with the greatest modified stroke, i.e., the greatest contraction A max/max equaling 19.2 mm, and the smallest maximal contraction A max/min equaling 13.8 mm. Similarly, good results are achieved with four stepwise variations. During this yarn deposit segment, the smallest modified stroke A max/min should equal at least about 50 percent, and preferably more than 60 percent of the greatest modified stroke A max/max.

The first yarn deposit segment having large stroke modification cycles is followed by the second yarn deposit segment having relatively small stroke modification cycles. The two yarn deposit segments preferably have about the same duration, so that the yarn is wound in layers of about the same thickness during the two segments. However, it is possible to vary the thicknesses of these two layers, by which the hardness or softness of the package can be influenced.

During the second yarn deposit segment of each interval, the stroke modification cycles are again varied by steps between A min/max and A min/min. As illustrated in FIG. 1, several groupings of stroke modification cycles may be employed, with the cycles of each grouping having the same magnitudes. Also, it is preferable that the smallest cycle A min/min of the small stroke modification cycles should amount to at least 50 percent, and preferably more than 60 percent of the largest of the small stroke modification cycles A min/-max. In addition, the small stroke modification cycles A min are preferably less than about one third of the large stroke modification cycles A max, and preferably less than one fourth of the large cycles. Here again, the possibility of variations in these parameters may be employed to influence both the hardness of the package and its unwinding properties.

As further indicated in the diagrams of FIG. 1, the stroke modification cycles occur synchronously with the ribbon breaking process, and the individual yarn deposit segments alternate one after another without an intervening rest time. To this end, the contraction speed of the stroke modification cycles from one yarn deposit segment to the next is so coordinated that a synchronization is obtained with the cycle of the ribbon breaking. The contraction speed of the stroke modification cycle is the shortening of the stroke of the traversing yarn guide per one reciprocal movement, i.e. double stroke, of the traversing yarn guide. The contraction speed is proportional to the angle of inclination or lead of the zig-zag lines shown in FIG. 1, which indicate the respective stroke reversal points U of the traversing yarn guide. Similarly, the lengthening speed is the increase of the stroke of the traversing yarn guide per one double stroke of the traversing yarn guide, and is proportional to the angle of inclination of the descending leg of the illustrated cycles.

As the yarn deposit segment with the small stroke modification cycles proceeds, a switchover to a stroke modification cycle with the next smaller cycle occurs concurrently with a change in direction in the ribbon breaking cycle. In addition, during the period of time a ribbon breaking cycle is operative, the extent of the modified strokes remains constant.

Figure 2:
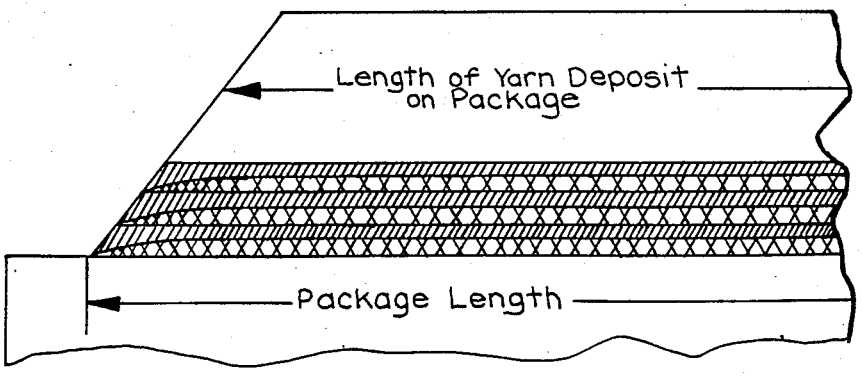
FIG. 2 is a schematic longitudinal sectional view of a package produced in accordance with the method of the present invention.

A biconical package formed in accordance with the method of the present invention, is illustrated schematically in FIG. 2. The package consists of a plurality of different built-up layers, with six such layers being illustrated. The wound layers which are produced during the yarn deposit segment of large stroke modification cycles have highly flattened but soft ends. These layers are illustrated by cross hatching. The wound layers which are produced during the yarn deposit segments having relatively small stroke modification cycles have hard ends, and are illustrated by section hatching. As can be seen, these hard wound layers substantially fill each of the flattened end areas of the previously wound layers, so that substantially hard wound layers come to lie and cover the ends of the package. It will also be noted that the package illustrated in FIG. 2 is biconically wound, and incorporates the modification of the invention illustrated in FIG. 3.

Figure 3:
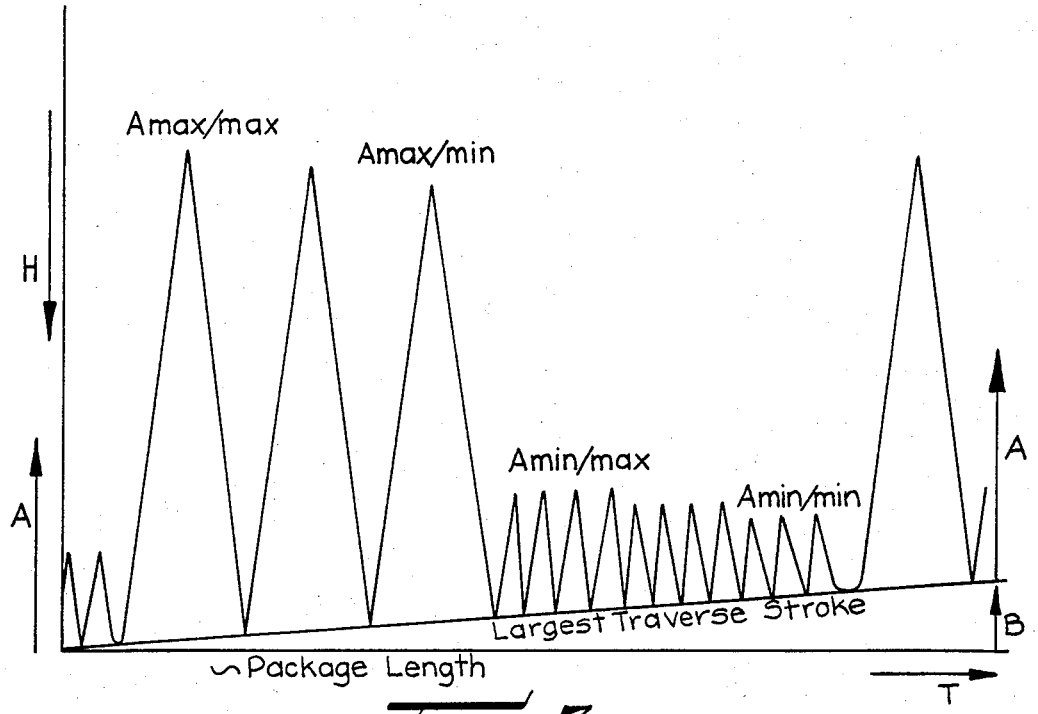
FIG. 3 is a motion diagram illustrating the effects of a further traverse stroke modification for producing a package with biconical winding.

The process illustrated in FIG. 3 differs from that of FIG. 1 only in that a further contraction B of the traverse stroke is superimposed upon the contractions A resulting from the stroke modification cycles. As the winding process proceeds, the contraction B increases proportionally to the build of the package, and so that the length of the yarn deposit on the package is progressively reduced in proportion to the package size.

Figure 4:
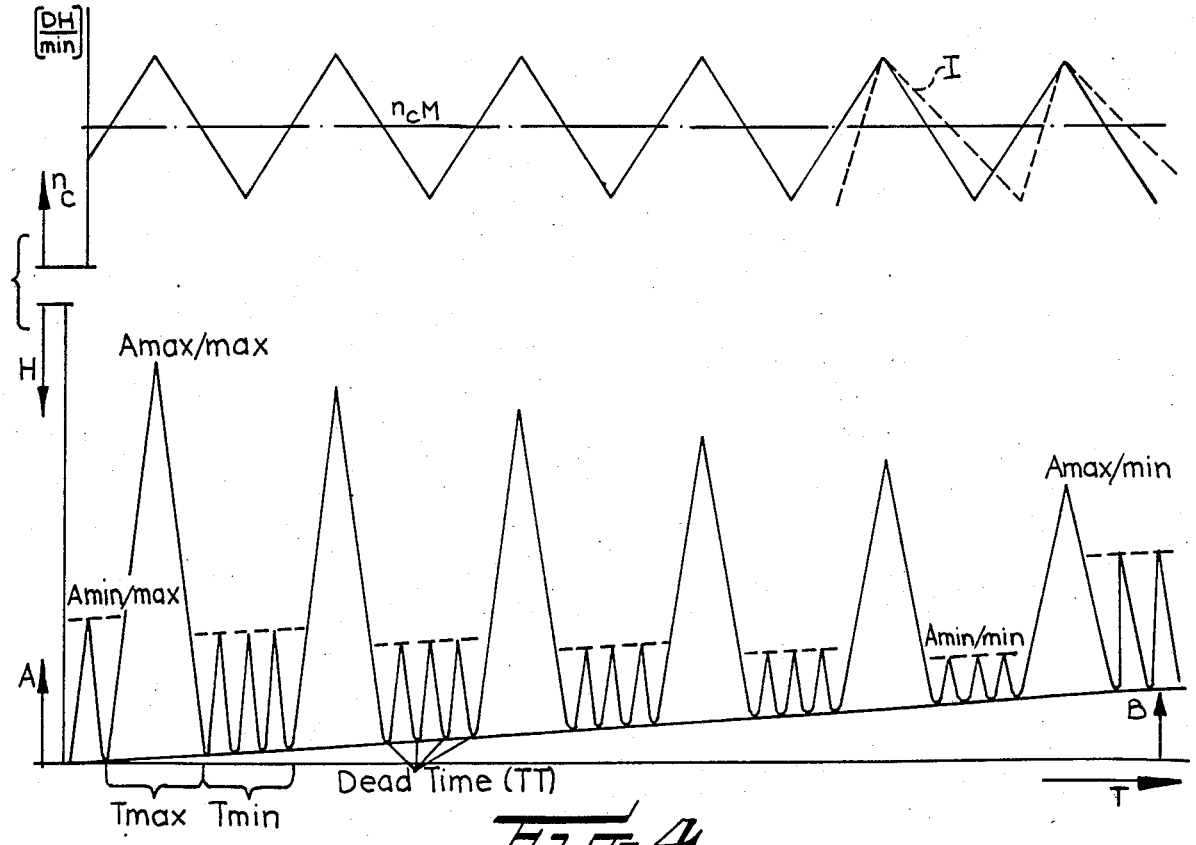
FIG. 4 is a motion diagram illustrating another embodiment of the present invention.

FIG. 4 is a motion diagram of another winding process in accordance with the present invention. The illustrated method has the advantage that the yarn layers which are produced in the yarn deposit segment of relatively large stroke modification cycles, and as a result have relatively soft ends, are very thin. After this yarn deposit cycle, the thin layers are bound in and held in place during the immediately following yarn deposit segment with relatively small stroke modification cycles. As a result, the homogeneity of the package with respect to its hardness can be improved to a further extent as compared to the package of FIG. 2.

The lower portion of the diagram of FIG. 4 illustrates the end of the traverse stroke H. The upper half shows the traversing speed nC, in terms of double strokes per minute. As can be seen in the lower half of FIG. 4, the traverse stroke H varies continuously in its length. In addition, a uniform contraction B of the traverse stroke proceeds in time, which is necessary to produce a biconical package. It should here be noted that this contraction is in general identical on both ends of the package, so that a package is formed which is symmetrical to its centrally located normal plane.

FIG. 4 also illustrates that contractions A as described above also proceed, and which result from the control of the traverse of the yarn guide in a recurrent series of yarn deposit intervals. The intervals are divided into two segments, with the first segment having a single relatively large stroke modification cycle A max and the second segment having a number of relatively small stroke modification cycles A min. The first and second segments alternate continuously. The small stroke modification cycles are identical within each of the second segments, and there are rest times between the stroke modification cycles of the second segment in which the traverse stroke is not shortened for the purpose of stroke modification. The largest contraction length of the large stroke modification cycles, i.e., the maximum modified stroke, is indicated at A max/max. In this embodiment, the large stroke modification cycles do not remain uniform, but decrease in steps, with the minimal large stroke modification cycle being indicated at A max/min.

The largest small contraction length, i.e., the maximum small stroke modification cycle is indicated at A min/max. The lower half of FIG. 4 also illustrates that the small stroke modification cycles similarly decrease in steps, with the minimum small stroke modification cycle being indicated at A min/min.

The rest times between the small stroke modification cycles are of such a duration that the time ratio TG/TK is between about 1.8 and 1.2. A preferred value is about 1.5. TG represents T max in FIG. 4, which is the duration of the first yarn deposit segment having a single large stroke modification cycle (A max), and TK represents T min in FIG. 4 which is the duration of the second yarn deposit segment having small stroke modification cycles, less the rest time between the small stroke modification cycles. Thus TK is the sum of the individual stroke modification cycles within the second segment.

As can further be seen in the lower half of FIG. 4, the contraction of the large stroke modification cycles between A max/max and A max/min, and the contraction of the small stroke modification cycles between A min/-max and A min/min proceed in the same manner. As a result, A max/max and A min/max follow each other directly, and similarly A max/min and A min/min follow each other directly.

As also will be noted in FIG. 4, the change of the traversing speed for the purpose of breaking a ribbon is synchronized with the contraction of the traverse stroke, so that the peak of the large stroke modification cycles coincides with the maximum traversing speed, whereas the minimum of the traversing speed is in the mid point of the second yarn deposit segment having small stroke modification cycles (A min). This synchronization permits the increase of the traversing speed for the purpose of ribbon breaking to be compensated by lowering the traversing speed which results, at a given rate of double strokes, from the contraction of the traverse stroke. In addition, change of the traversing speed for ribbon breaking purposes as is plotted in dashed lines I on the right side of the upper portion of the diagram, may be avoided. Such an asymmetrical law of motion has the disadvantage that the traversing speed is slowly reduced, and that there is a risk that possible ribbon areas may be passed very slowly, which in turn would not effectively eliminate the ribbon symptons.

Preferably, the contraction length of the large stroke modification cycles A max ranges between about 10 to 20 mm. The contraction length of the small stroke modification cycles A min is between 2 and 5 mm. It should also be noted that in the course of a winding operation the stroke modification cycles need not remain uniform. In particular, the duration of the contraction legs may be increased. However, the time ratio TG/TK as defined above preferably remains constant.

Figure 5:
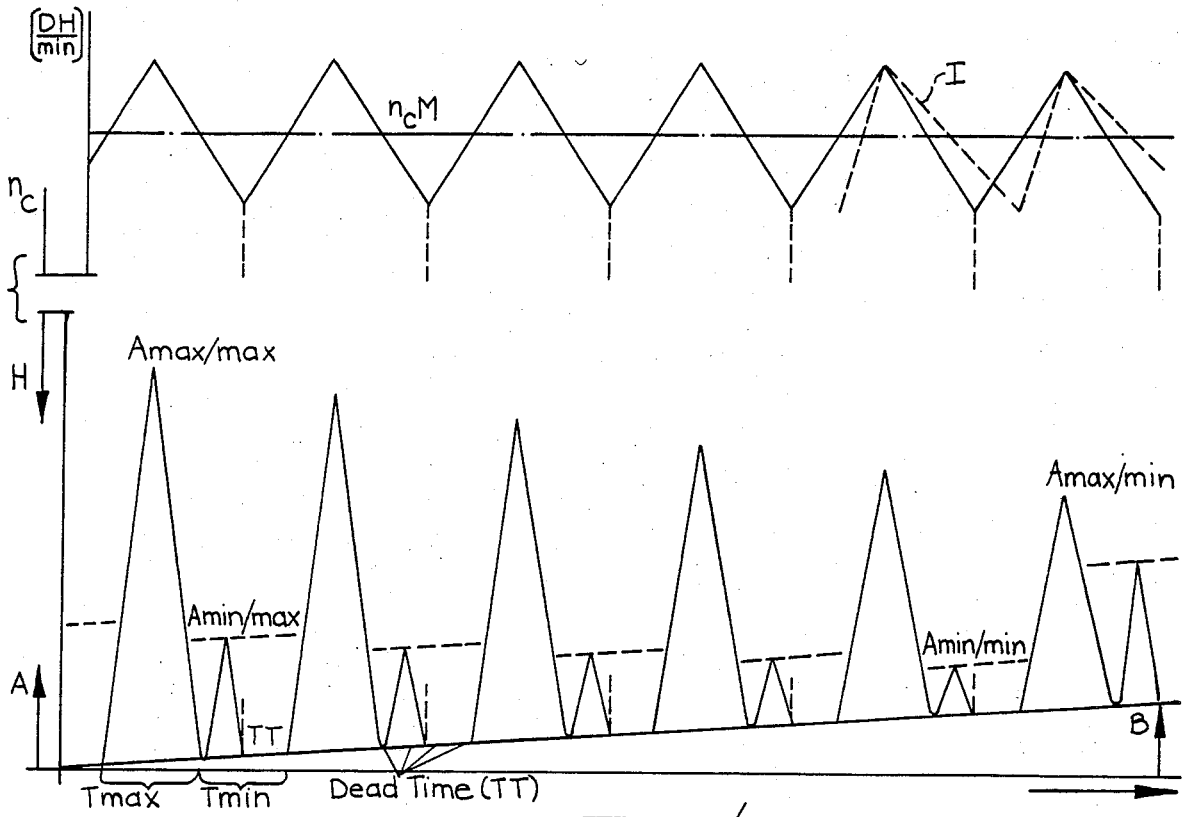
FIG. 5 is a motion diagram illustrating still another embodiment, which includes a variable rest time.

Another embodiment of the present invention is illustrated in conjunction with FIG. 5. This embodiment is characterized in that a change of the contraction and lengthening speeds of a stroke modification cycles permits the time ratio TG/TK to be not only predetermined, but also that a portion of the rest time to be predetermined. Further, the stroke modification cycles may be synchronized with the ribbon breaking in a desired fashion. The lower portion of the diagram again shows that a constant contraction B of the traverse stroke occurs in time, so as to produce a biconical package. There are also the contractions A which are defined by the stroke modification cycles. The stroke modification cycles are again divided into two segments of differing magnitude, which alternate constantly. The yarn deposit segment T max with a relatively large stroke modification cycle is followed by the yarn deposit segment T min having a relatively small stroke modification cycle and a rest time TT. The duration of T max is predetermined not only by the magnitude of the maximum modified stroke, but also by the selection of the contraction and lengthening speeds of the cycle. The duration of the stroke modification cycle within the second segment, i.e. T min minus TT, is similarly predetermined by a corresponding selection of the contraction and lengthening speeds in such a manner that there is a desirable synchronization with the ribbon breaking. The diagram of the ribbon breaking is shown in the upper half of FIG. 5, with the zig-zagged line indicating the traverse speed which is symmetrically varied about a mean traversing speed nCM. The parameters of the stroke modification are adapted so that the maximum modified stroke coincides with the highest traversing speed, and the end of each small stroke modification cycle coincides with the lowest traversing speed. As previously noted, this synchronization of ribbon breaking and stroke modification achieves a desirable uniformity of the yarn tension.

The variability of the contraction and/or lengthening speeds of the stroke modification cycles with respect to each other, or from one yarn deposit segment to another, also results in the advantageous possibility of adapting the time sequence of the ribbon breaking and the time sequence of the stroke modification to each other.

It has also been found that a particularly favorable and uniform package, with uniform hardness and good unwinding properties, may be achieved by an arrangement wherein the stroke modification does not always proceed from the traverse stroke ends which determine the length and the form of the package. Rather, the ends of the traverse stroke, i.e. the outer limits of the traverse stroke, are intermittently displaced in a direction toward the center of the package, preferably by an amount between 1 and 10 mm. In so doing, the stroke modification, or contraction length in the context of the present invention, forms from the displaced end of the traverse stroke. As a result, the outer limits of the yarn length deposited by the traversing system are temporarily narrowed or reduced. This narrowing preferably occurs during the yarn deposit segments having the small stroke modification cycles. It is also possible to displace the inner limits of the traverse stroke in the same or opposite direction, or to leave the inner limits.

Figure 6:
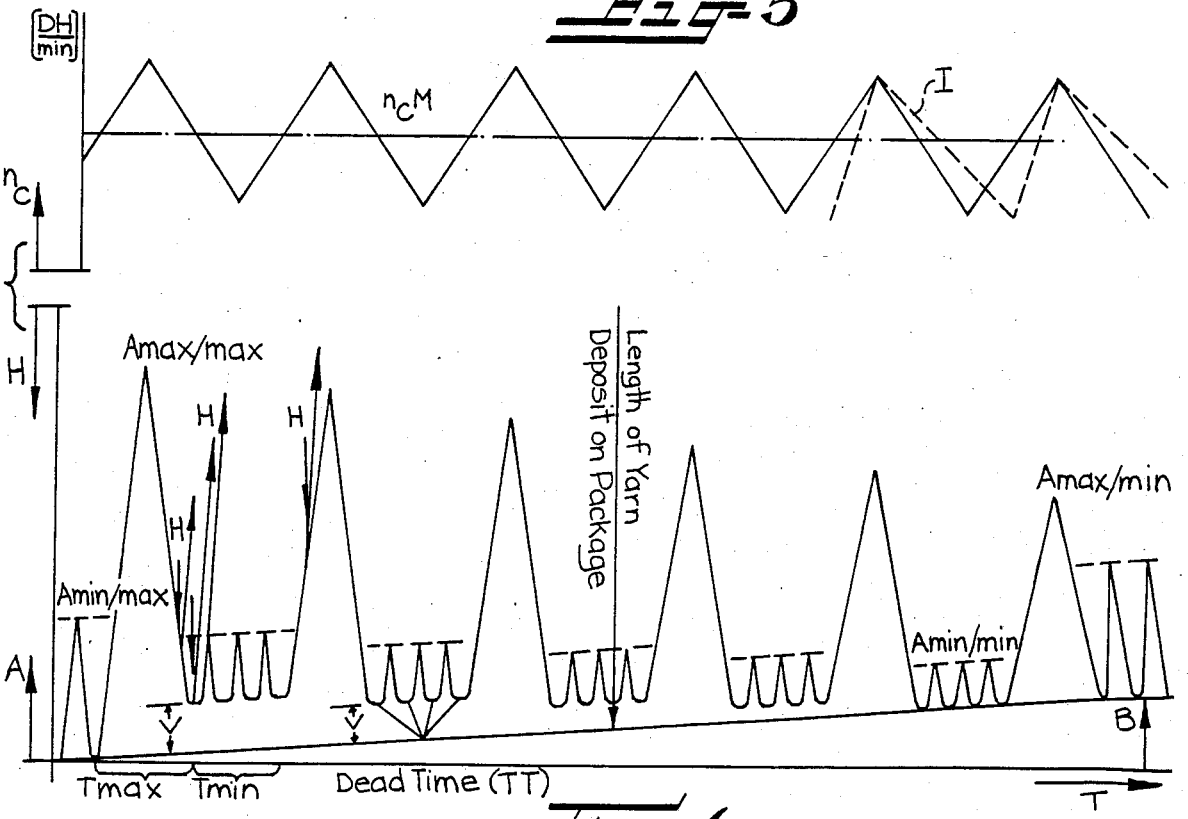
FIG. 6 is a motion diagram of still another embodiment, which includes a temporary narrowing of the stroke of the traversing yarn guide relative to the length of the yarn deposited on the package.

FIG. 6 illustrates a method of traversing the yarn which incorporates such a narrowing of the traverse stroke relative to the length of the yarn deposited on the package. Here, both the outer and inner limits of the traverse stroke are displaced, and as a result, it is provided that the modified stroke, which is the difference in length between the inner and outer limits of the traverse stroke, can be carried out over varying areas of the package length, and with changing magnitudes.

The lower half of FIG. 6 again illustrates the end area of the traverse stroke H. The upper half illustrates the traversing speed nC, in terms of double strokes DH per minute. The method of ribbon breaking, i.e. the variation of the traversing speed nC for ribbon breaking purposes, is the same as the method described in conjunction with FIGS. 4–5.

Again referring to the lower half of FIG. 6, the traverse stroke H varies continuously in length. On the one hand, there is the constant contraction B which occurs with time which is required to produce a biconical package. This contraction B permits the determination of the outer limit of the traverse stroke in FIG. 6, and it should be noted that the contraction B is the same on both ends of the package so that a package is formed which is symmetrical to a center normal plane. The traverse stroke between these ends of the package is described as the yarn deposit length, and this yarn deposit length or contraction B also determines the ends and the configuration of the package.

In FIGS. 1, and 3–5, a method is described in which the traverse stroke is shortened on the basis of the yarn deposit length, whereas in FIG. 6 the yarn deposit length is narrowed, i.e. the outer limit of the traverse stroke is periodically located inwardly by an amount indicated at V. In FIG. 6, the stroke modification cycles are again divided into first and second yarn deposit segments as described above, wherein A max is the segment having large stroke modification cycles and A min within the segment having relatively small stroke modification cycles. Also, the two yarn deposit segments alternately follow each other, and during the first yarn deposit segment a large stroke modification occurs, and in the second yarn deposit segment several small stroke modification cycles occur. The maximum contraction length of the large cycles is indicated at A max/max, and the maximum small contraction length, i.e. the maximum contraction of the relatively small cycles is indicated at A min/max. As in the method of FIG. 5, the inner limit of the traverse stroke is continuously varied.

In the method of FIG. 6, the yarn deposit length is also temporarily narrowed or reduced, and thus the outer limit of the yarn deposit is displaced inwardly, with the yarn length initially being considerably narrowed after the first yarn deposit segment having the large stroke modification cycles. The amount V of the narrowing may for example amount to 8 mm measured at one end of the package. The following yarn deposit segment with the small stroke modification cycles then occurs on the basis of this narrowed yarn deposit length, with the traverse stroke being carried out over the entire narrowed yarn deposit length during the rest times TT. Next, a yarn deposit segment with a large stroke modification cycle follows, with the total contraction length being less than the contraction length of the preceding large stroke modification cycle. In the next yarn deposit segment having short cycles, the amount V by which the yarn deposit length is narrowed, is reduced for example to about 6 mm. The stroke modification occurs on the basis of this yarn deposit length, and the modified stroke of the relatively small cycles is less than the stroke of the small cycles of the preceding segment.

During the following yarn deposit segments, the large stroke modification cycles, the small stroke modification cycles, and the narrowing V of the deposit length are further reduced. Such a length of stroke modification having a narrowed yarn deposit length may then be followed by a length of stroke modification as shown for example in FIGS. 4 or 5.

Figure 7:
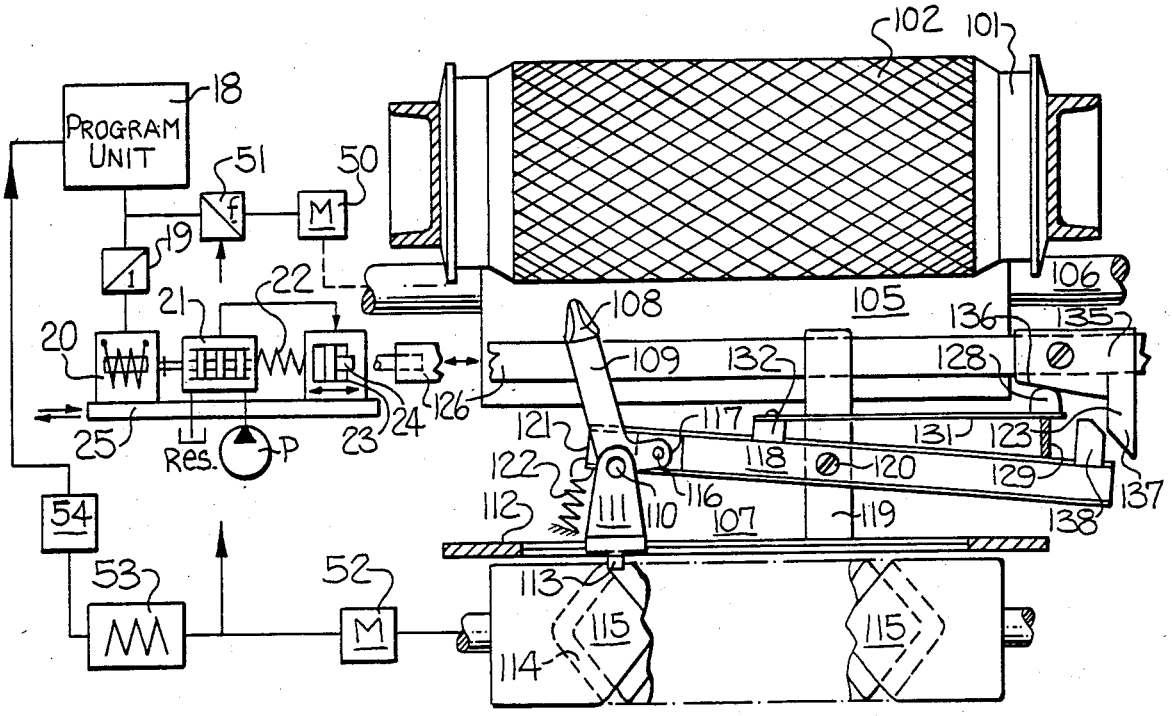
FIG. 7 is a partly schematic front elevation view of a winding apparatus in accordance with the present invention.

FIG. 7 shows an apparatus for winding a yarn onto a package by the method of this invention. In this regard, reference is made to FIG. 3 of U.S. Pat. No. 3,730,448, and essentially identical German Pat. No. 19 16 508. The numerals of FIG. 3 of U.S. Pat. No. 3,730,448 have been increased by 100 for designating identical parts in FIG. 7 of this disclosure. Generally, FIG. 7 illustrates a package 102 which is being wound on bobbin tube 101. The package is driven by friction roller 105 mounted on shaft 106. The shaft is driven by motor 50 via a frequency inverter 51. The traversing mechanism is generally indicated at 107, and comprises a yarn guide 108 mounted on one arm of a toggle lever 109 which is pivotably mounted on pin 110. Pin 110 is fixed to slide 111 which is driven by shoe 113 riding in a helical or spiral groove 114 of cam drum 115. The shoe 113 extends through a slot in the guide plate 112, so that the slide 111 is reciprocated along a direction parallel to this axis of the drum 115 by rotation of the drum. A slide block 117 is pivotally mounted to the other arm of the toggle lever by the pin 116, and a guide rail 118 is provided for receiving the slide block 117. The guide rail 118 is pivotably mounted on pivot axis 120, and a spring 122 extends between one end of the rail and the machine frame for biasing such end in a downward direction.

As will be apparent, the traverse stroke of yarn guide 108 depends on the inclination of guide rail 118. For defining the inclination of guide rail 118, there is provided a cam head 135 which is mounted on a bar 126. Bar 126 preferably serves a series of side-by-side winding stations and has a central drive as further described below. The working surface 136 of cam head 135 acts on the guide rail 118 through the transmission cam 128 and the transmission element 129, and thereby determines the inclined position of the guide rail and hence the length of the traversing stroke. Transmission element 129 serves to produce packages 102 having biconical ends by diminishing the traverse stroke in dependency on the increasing diameter of package 102, and a further description of the element 129 may be obtained from the above-mentioned U.S. Pat. No. 3,730,448. For making packages having flat ends, the guide rail 126 is pulled and adjusted to the left in the manner described below, so that the working surface 137 of cam head 123 cooperates with the shoulder 138 on guide rail 118. In this position, transmission element 129 is out of operation because of the increased inclination of guide rail 118.

The left hand portion of FIG. 7 schematically illustrates a preferred embodiment of means for driving and adjusting the bar 126. This drive means includes a program unit 18, an output-to-current converter 19, and an electromagnet 20, the magnetic force of which is transmitted to hydraulic control valve 21, to a spring 22, and to the cylinder and piston unit 23. The piston rod 24 of the unit 23 is connected to the end of adjusting bar 126. The assembly consisting of magnet 20, control valve 21, spring 22, and cylinder and piston unit 23 is mounted on a support slide 25.

Figure 8:
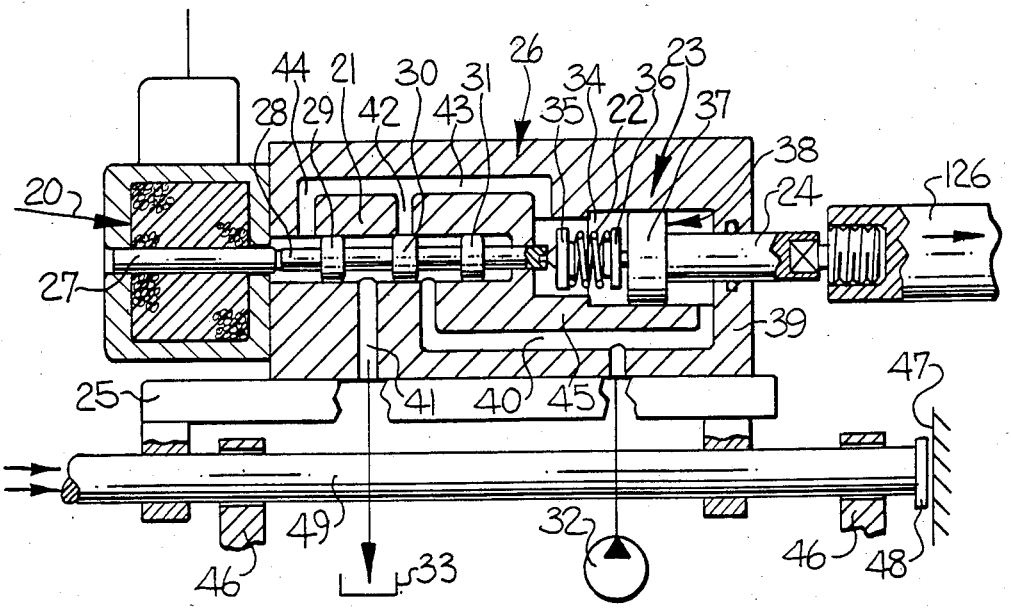
FIG. 8 is a schematic sectional view of the fluid control valve shown in FIG. 7.

As seen in FIG. 8, a unitary housing 26 is provided which mounts the electromagnet 20, the hydraulic control valve 21, the spring 22, and the cylinder and piston unit 23. The iron core 27 of magnet 20 acts upon the rod 28 of control valve 21. The rod 28 has three collars 29, 30, 31 for controlling the fluid connections between hydraulic pump 32, reservoir 33 and the rear 34 of the cylinder and piston unit 23. The spring 22 acts upon the other side of rod 28 via a suitable support plate 35, and the other end of the spring 22 acts upon support plate 36 and piston 37 of cylinder and piston unit 23. The piston 37 is a differential piston, since the front face 38 is diminished by the area of piston rod 24. The front face 38 of piston 37 is permanently connected by duct 39 to pump 32. The rear 34 of piston 37 is connected to either the pump 32 via duct 40 or to reservoir 33 via duct 41. This connection is controlled by movement of collar 30 which connects duct 41 to either one of duct 40 and 42.

One branch 43 of duct 42 leads to the rear 34 of the cylinder and piston unit 23. The other branch 44 serves to equalize the pressure on both sides of the hydraulic control valve. It should be noted that piston 37 in its outer left hand position lies upon a shoulder 45 of the cylinder. Thereby, the outermost stroke ends of the package are mechanically defined.

As also shown in FIG. 8, the housing 26 is supported by a frame 25 which is mounted on two parallel rods 49. The rods 49 are in turn slidably mounted to the supports 46. The frame 25 is movable between two positions, the one being defined by the stop 47, and the other being defined by flange 48 which is adapted to engage the adjacent support 46.

In operation, any of the winding programs as shown in the preceding drawings and diagrams may be stored in the program unit 18. The program unit produces an output signal which corresponds to a certain stroke length according to one of the traverse programs provided by this invention. This output signal is transformed by transducer 19 into an electrical current activating the magnet 20. The magnetic force is transmitted to piston rod 28 of control valve 21, to spring 22 and to piston 37 and piston rod 24.

The function of the control means may be described by reference to the position of the control valve 21 as shown in FIG. 8. A certain output signal may be related to a current generating a force on iron core 27 pushing the piston rod 28 with collar 30 into the shown position. In this position, duct 42 is closed. Therefore, the front face 38 of the piston 37 is acted upon by the fluid flow from pump 32, and the rear 34 is closed. Consequently, piston 37 and piston rod 24 are locked in the shown position.

The change of the output signal of program unit 18 causing an increasing current to electromagnet 20 will lead to an increasing force of iron core 27 to the right. Consequently, duct 42 will be opened to duct 41 leading to the reservoir 33. This will cause a pressure drop on rear 34 of the cylinder and piston unit 23, and the pump pressure on the front face 38 will shift the piston 37 and rod 24 to the left. Thereby the spring 22 will be compressed and the spring force will tend to shift rod 28 of control valve 21 to the left with a tendency of collar 30 to close duct 42 with respect to the duct 41 and the reservoir. Thus, the force generated by the iron core 27 will be balanced by spring 22. If in turn the current is decreased, spring 20 will shift rod 28 to the left, and collar 30 will open duct 42 to branch 40 leading to the pump. Now, the pump pressure will act on both sides of piston 37. Since the active area on rear 34 is greater than active area on front face 38, the piston 37 will be moved to the right. Thereby, spring 22 is expanded and the spring force acting on rod 28 is released. Now, the magnetic force on iron core 27 will have a tendency to move rod 28 to the right and to cause collar 30 to close the connection between duct 42 and pump branch 40.

It will be apparent from the above description that each input current to electromagnet 20 is related to a certain position of the piston 37, rod 24 and consequently to bar 126 and the inclination of the guide rail 118. Thereby, the output of program unit 118 controls the stroke length of yarn guide 108.

As mentioned above, housing 26 is mounted to a frame 25, and in the illustrated position where flange 48 abuts stop 47, the housing 26 and bar 126 are adjusted such that cam head 135 on bar 125 is active to control the inclination of guide rail 118. In this position of frame 25 and housing 26, biconical packages 102 are thus produced. In the other position of the frame 25, where flange 48 abuts support 46, cam head 123 of bar 126 cooperates with shoulder 138 on guide rail 118, and packages 102 having flat ends are produced.

In FIG. 7 it is also indicated that shaft 106 of friction roller 105 is driven by motor 50. Motor 50 is controlled by the output of the frequency converter 51. Cam drum 115 is driven by a motor 52 and the motor 52 is controlled by the program unit 53 which causes a changing traverse motion speed to prevent undesirable pattern formations in the yarn winding. Frequency converter 51 is, on the one hand, controlled by the output signal of program unit 18 representing the stroke modification pursuant to this invention, and on the other hand by the output of program unit 53 representing the change of the traverse motion speed. Thereby, any variation of the tension of the yarn to be wound on package 102 caused by either stroke modification and/or change of traverse motion speed can be compensated by slight fluctuations of the peripheral speed of friction roller 105 and package 102. Timer 54 coordinates the outputs of the program units 18 and 53 for the stroke modification and the traverse speed modification in accordance with this invention, and particularly the above diagrams.

From the above description, it will be apparent that the method and apparatus of the present invention is adapted to provide a stroke modification in the area of the package end where it is necessary or desired to obtain a good, uniformly hard package build up, and good unwinding properties.

In the drawings and specification, there has been set forth a preferred embodiment of the invention, and although specific terms are employed, they are used in a generic and descriptive sense only and not for purposes of limitation.

That which is claimed:

1. In a method of winding textile yarns into core supported packages in which the yarn is wound about the core at a substantially constant speed while the yarn is guided onto the core by a traversing yarn guide, the improvement therein comprising controlling the traverse of the yarn guide at at least one end of the package in a recurrent series of yarn deposit intervals, with each interval comprising at least two segments, with the first segment including at least one stroke modification cycle which includes the steps of progressively decreasing the length of the strokes of the yarn guide to a relatively large contraction and then progressively increasing the length of the strokes, and with the second segment including at least one stroke modification cycle which includes the steps of progressively decreasing the length of the strokes of the yarn guide to a relatively small contraction and then progressively increasing the length of the strokes, and with the relatively small contractions of the second segments being less than about 60 percent of the relatively large contractions of said first segments.

2. A method according to claim 1 wherein the two segments of each of said yarn deposit intervals are of substantialy uniform duration.

3. A method according to claim 1 including the further step of providing at least one rest period during which the traverse stroke is unchanged during each of said intervals.

4. A method according to claim 1 including the further step of providing at least one rest period during which the traverse stroke is unchanged during said second segment of each of said intervals.

5. A method according to claim 4 wherein the length of the traverse stroke during said rest periods is less than the length of the yarn deposited on the package, and with the extent of the reduced length being less than the length of said relatively small contractions.

6. A method according to claim 1 including the step of progressively decreasing the length of the yarn traverse stroke at each end of the package and over the entire build thereof, so as to produce a biconical package.

7. A method according to claim 1 wherein one or both of said first and second segments of each of said intervals comprises a plurality of stroke modification cycles.

8. A method according to claim 7 including the step of progressively changing the extent of the contractions of at least some of said plurality of stroke modification cycles.

9. A method according to claim 1 wherein said first segment of each of said intervals comprises a single stroke modification cycle, and said second segment of said interval comprises a plurality of stroke modification cycles.

10. A method according to claim 9 including the step of progressively changing the extent of the contractions of the stroke modification cycles of said second segments.

11. A method according to claim 9 including the further step of providing a rest period between each of the stroke modification cycles of said second segment, during which rest periods the traverse stroke is substantially unchanged.

12. The method according to claim 11 wherein said rest periods have a duration such that the time ratio TG/TK ranges between about 1.8 and 1.2, with TG being the duration of one stroke modification cycle within said first segment and TK being the sum of the individual stroke modification cycles within said second segment.

13. A method according to claim 1 wherein the stroke modification cycles recur without any intermediate rest periods during which the traverse stroke is unchanged.

14. A method according to claim 1 including the further step of casuing the stroke modification cycles to occur more frequently and/or over a longer period of time at one end of the package than the other end.

15. A method according to claim 1 wherein each stroke modification cycle within said first intervale has a length between about 10 and 20 mm, and each stroke modification cycle within said second interval has a length between about 2 and 5 mm.

16. A method according to claim 1 comprising the further step of constantly varying the traverse speed of said yarn guide between a minimum value and a maximum value.

17. A method according to claim 16 wherein the maximum value of the varying traverse speed occurs during said first segment at the time of a maximum contraction, and with the minimum value occurring during a medial portion of the second segment.

18. A method according to claim 17 comprising the further step of controlling the rotational speed of the package together with the constant varying of the traverse speed and the parameters of the stroke modification cycles to obtain a substantially uniform yarn tension in the package.

19. An apparatus for winding textile yarns into core supported packages including means for rotating the core to wind the yarn thereabout at a substantially constant rate, yarn guide means movable axially with respect to the core for guiding a running yarn onto the core, and means for traversing said yarn guide means, the improvement therein comprising control means operatively connected to said traversing means for controlling the traverse of the yarn guide at at least one end of the package in a recurrent series of yarn deposit intervals, with each interval comprising at least two segments, with the first segment including at least one stroke modification cycle in which the length of the strokes of the yarn guide is progressively decreased to a relatively large contraction and then progressively increased, and with the second segment including at least one stroke modification cycle in which the length of the strokes of the yarn guide is progressively decreased to a relatively small contraction and then progressively increased, and with the relatively small contractions of the second segments being less than about 60 percent of the relatively large contractions of said first segments.

20. In the apparatus according to claim 19 wherein said control means further comprises means for continuously changing the traverse motion speed of said yarn guide means by accelerating and decelerating said traversing yarn guide means between predetermined maximum and minimum speeds to prevent undesirable pattern formations in the yarn windings in the package formed thereby.

21. In the apparatus according to claim 20 wherein the time of the highest traversing speed of the accelerating and decelerating yarn traversing guide coincides with the time of the maximum contraction of one of the relatively large stroke modification cycles, and wherein the lowest traversing speed of the yarn guide coincides with a medial portion of said second segment of a yarn deposit interval.

22. In the apparatus according to claim 19 wherein said control means includes means for selectively controlling the rate of the decrease in the stroke length of each stroke modification cycle and/or the rate of the increase in the stroke length of each stroke modification cycle.

23. In the apparatus according to claim 19 wherein said control means includes program storage means for storing a predetermined series of signals which represent a series of yarn deposit intervals, and means for producing an output signal in accordance with said stored series of signals.

24. In the apparatus according to claim 23 wherein said means for traversing said yarn guide means comprises a toggle lever having two arms, with a yarn guide mounted on one arm and with the other arm pivotally connected with a slide member, and with said slide member being slidably mounted in a pivotally mounted guide rail, and wherein said control means further includes means operatively controlled by said output signal for varying the inclination of said guide rail to thereby control the stroke length of said yarn guide means.

25. In the apparatus according to claim 24 wherein said means for varying the inclination of said guide rail comprises electromagnetic means for generating an electromagnetic force in response to the magnitude of said output signal, a drive member operatively connected to said guide rail such that movement of said drive member varies the inclination of said guide rail, and fluid control valve means including a source of pressurized fluid for moving said drive member in response to said electromagnetic force.

26. In the apparatus according to claim 25 wherein said fluid control valve means further includes a slideable valve rod, and resilient feedback means interposed between said valve rod and said drive member.

27. In the apparatus according to claim 26 wherein said drive member comprises a piston slideably mounted in a housing.

* * * * *